US009995526B2

(12) United States Patent
Kim

(10) Patent No.: US 9,995,526 B2
(45) Date of Patent: Jun. 12, 2018

(54) APPARATUS AND METHOD FOR MAKING ICE BY DIRECT COOLING AND FOR PREVENTING ICE FROM MELTING IN REFRIGERATION EQUIPMENT

(71) Applicant: Dongbu Daewoo Electronics Corporation, Seoul (KR)

(72) Inventor: Dong Sun Kim, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 120 days.

(21) Appl. No.: 14/839,574

(22) Filed: Aug. 28, 2015

(65) Prior Publication Data

US 2016/0370092 A1 Dec. 22, 2016

(30) Foreign Application Priority Data

Jun. 17, 2015 (KR) ..... 10-2015-0086095

(51) Int. Cl.

| | |
|---|---|
| ***F25C 5/08*** | (2006.01) |
| ***F25D 17/06*** | (2006.01) |
| ***F25C 1/24*** | (2018.01) |
| ***F25C 5/18*** | (2018.01) |
| ***F25D 17/02*** | (2006.01) |

(52) U.S. Cl.

CPC ..... *F25D 17/065* (2013.01); *F25C 1/24* (2013.01); *F25C 5/08* (2013.01); *F25C 5/182* (2013.01); *F25D 17/02* (2013.01)

(58) Field of Classification Search

CPC ..... F25D 17/065; F25D 17/062; F25D 21/14; F25C 1/24; F25C 1/08; F25C 1/04; F25C 5/005; F25C 2400/10

See application file for complete search history.

(56) References Cited

U.S. PATENT DOCUMENTS

| | | | | |
|---|---|---|---|---|
| 3,568,465 A * | 3/1971 | Jung | F25D 17/065 62/272 |
| 3,590,911 A * | 7/1971 | Horvay | F25D 17/065 165/263 |
| 2005/0210909 A1* | 9/2005 | Kim | F25D 17/065 62/340 |
| 2008/0148761 A1 | 6/2008 | Venkatakrishnan et al. | |
| 2008/0210909 A1 | 9/2008 | Hsu et al. | |

(Continued)

FOREIGN PATENT DOCUMENTS

| | | |
|---|---|---|
| KR | 10-2006-0039169 A | 5/2006 |
| KR | 20-2006-0039169 A | 5/2006 |

(Continued)

*Primary Examiner* — Frantz Jules
*Assistant Examiner* — Steve Tanenbaum

(57) ABSTRACT

An ice maker for refrigeration equipment includes an ice making unit in the refrigerating compartment of the refrigeration equipment, an ice bucket disposed in the ice making unit and configured to store the ice made with an ice making tray, a cooling duct configured to form a cold air channel through which cold air is provided to the ice making unit, a refrigerant pipe enclosing the cooling duct to form a refrigerant channel, and an ice making refrigerant pipe configured make water into the ice through heat-exchange, where the ice making refrigerant pipe branches from the refrigerant pipe, and an end portion of the ice making refrigerant pipe is in the ice making tray.

15 Claims, 3 Drawing Sheets

(56) References Cited

U.S. PATENT DOCUMENTS

| | | | | |
|---|---|---|---|---|
| 2010/0031675 | A1* | 2/2010 | Kim | F25C 1/08 62/73 |
| 2012/0186292 | A1 | 7/2012 | Kim | |
| 2013/0167569 | A1 | 7/2013 | Lee | |

FOREIGN PATENT DOCUMENTS

| | | | |
|---|---|---|---|
| KR | 10-2008-0061469 | | 7/2008 |
| KR | 10-2012-0084095 | | 7/2012 |
| KR | 10-2013-0078532 | A | 7/2013 |
| SU | 1330425 | A1 * | 8/1987 |

* cited by examiner

APPARATUS AND METHOD FOR MAKING ICE BY DIRECT COOLING AND FOR PREVENTING ICE FROM MELTING IN REFRIGERATION EQUIPMENT

RELATED APPLICATION

This application claims priority to Korean Patent Application No. 10-2015-0086095, filed Jun. 17, 2015 hereby incorporated by reference in its entirety.

FIELD

Embodiments according to the present invention relate to a method for making ice in refrigeration equipment, and more particularly, to an ice maker for refrigeration equipment capable of preventing ice stored in an ice bucket from being melted by providing cold air to the ice bucket using a ventilator installed in a cooling duct, and a method for making ice using the same.

BACKGROUND

As is well known, refrigeration equipment (e.g., a refrigerator) is equipped with space for holding foods at a low temperature above or below the freezing point of water, and which may be divided into a refrigerating compartment, the interior of which is kept above the freezing point, and a freezing compartment, the interior of in which is kept below the freezing point, according to a low temperature range.

In recent times, with increased demand for purified water and ice in the home, the demand for refrigeration equipment in which a water purifier and an ice maker are formed integrally with each is also increasing. The aforementioned ice maker may be installed in any one of the freezing compartment, the refrigerating compartment, or a door thereof, depending on the design of the refrigeration equipment.

Further, the ice maker may include an ice making tray containing water to be used to make ice and an ice bucket for storing (keeping) the ice transferred from the ice making tray.

In the ice maker, cold air flowing in the ice maker through a cooling duct is used to turn the water contained in the ice making tray into ice. For this, a cooling duct structure for a cold air channel is located between the freezing compartment and the ice maker, and a ventilator for ventilating the cold air in the freezing compartment toward the ice maker is installed at one side (end) of the cooling duct structure.

However, the conventional method for making ice using the cold air from the freezing compartment inflowing through the cooling duct results in a relatively long ice making time, which causes dissatisfaction among users of the refrigeration equipment.

In addition, the ice stored in the ice bucket may melt due to a change in temperature in the ice maker. As a result, the melted ice in the ice bucket is frozen together with nearby ice, which may inconvenience a user.

SUMMARY

In view of the above, embodiments according to the present invention provide a method for making ice in refrigeration equipment, where the method prevents ice stored in the ice bucket from being melted, by providing cold air discharged from a cooling duct to the ice bucket.

Further, embodiments according to the present invention provide a method for making ice in refrigeration equipment by using a refrigerant channel to bring refrigerant into contact (thermal contact) with the water to be used to make the ice in an ice making area in which an ice making tray is installed.

The technical scope of the present invention is not limited to the aforementioned technical scope, and other technical scope not mentioned above will be apparent to those skilled in the art from the following description.

An embodiment of the present invention provides an ice maker for refrigeration equipment. The ice maker includes: an ice making unit positioned in a refrigerating compartment of the refrigeration equipment, an ice bucket disposed in the ice making unit and configured to store ice made with an ice making tray, a cooling duct configured to form a cold air channel through which cold air is provided to the ice making unit, a refrigerant pipe enclosing at least a portion of the cooling duct to form a refrigerant channel, and an ice making refrigerant pipe configured to make water into ice through heat-exchange, where the ice making refrigerant pipe branches from the refrigerant pipe, and an end portion of the ice making refrigerant pipe is in the ice making tray.

In an embodiment, the end portion of the ice making refrigerant pipe in the ice making tray is submerged in the water in the ice making tray.

In an embodiment, the ice maker includes a ventilator configured ventilate the cold air discharged from the cooling duct to the ice bucket.

In an embodiment, the cooling duct has a structure that is configured for collecting the cold air being discharged and for returning the collected cold air to an inlet side of the cooling duct.

In an embodiment, the end portion of the ice making refrigerant pipe has a number of pipe protrusions which are downwardly bent.

In an embodiment, the ice maker includes a heating member for separating the ice that is frozen on the end portion of the ice making refrigerant pipe.

In an embodiment, the heating member for separating ice includes a heater powered by a power supply of the refrigeration equipment.

Another embodiment of the present invention provides a method for making ice in refrigeration equipment. The method includes: containing water in an ice making tray, making ice from the water in the ice making tray by transferring a refrigerant to the water through an ice making refrigerant pipe which branches from a refrigerant, channel and has an end portion that is submerged in the water in the ice making tray, executing an ice separation mode using a heating member installed on the end portion of the ice making refrigerant pipe so that the ice separated from the ice making tray can be stored in an ice bucket, and discharging cold air to the ice bucket through a cooling duct which forms a cold air channel that is cooled by the refrigerant channel.

In an embodiment, the operation of discharging the cold air is executed using a ventilator which is installed on/in the cooling duct.

In an embodiment, the end portion of the ice making refrigerant pipe has a number of pipe protrusions which are downwardly bent.

In an embodiment, the refrigerant pipe encloses the cooling duct.

In an embodiment, the operation of making ice includes collecting the cold air being discharged and returning the collected cold air to an inlet side of the cooling duct.

Therefore, according to the present invention, it is possible to prevent the ice stored in the ice bucket from being melted by providing cold air to the ice bucket through the use of the ventilator installed in the cooling duct.

Also, the present invention is configured to bring the refrigerant into thermal contact with the water to be used to make ice through the refrigerant channel in the ice making area at which the ice making tray is installed. Consequently, the time of ice making may be shortened compared to a conventional indirect cooling method in which cold air is used to make ice, thus increasing the satisfaction of the users of the refrigeration equipment.

DETAILED DESCRIPTION OF THE EMBODIMENTS

The advantages and features of example embodiments according to the present invention and methods of accomplishing them will be clearly understood from the following description of the embodiments taken in conjunction with the accompanying drawings. However, the present invention is not limited to those embodiments and may be implemented in various forms. It should be noted that the embodiments are provided to make a full disclosure and also to allow those skilled in the art to know the full scope of the present invention. Therefore, embodiments are to be defined only by the scope of the appended claims.

In the following description, well-known functions and/or structures will not be described in detail if that description would unnecessarily obscure the features of the present invention. Further, the terms described below are defined in consideration of their functions in the embodiments of the present invention and their definitions may vary depending on a user's or operator's intention or practice. Accordingly, the definition may be made on a basis of the content and context throughout the disclosure.

Hereinafter, embodiments of the present invention will be described in detail with reference to the accompanying drawings.

Figure 1:
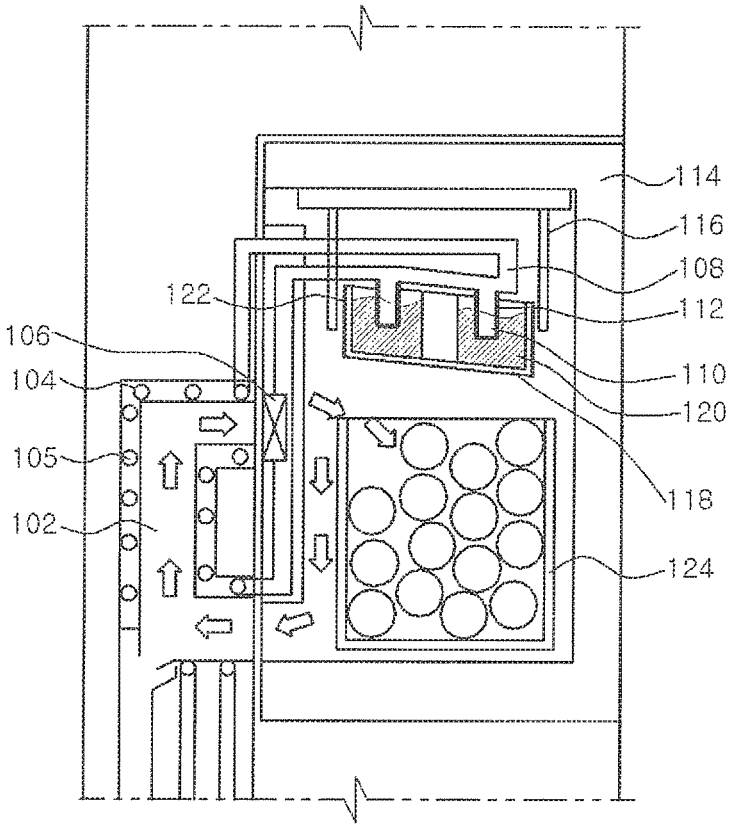
FIG. 1 is a cross-sectional view of an ice maker for refrigeration equipment in accordance with an embodiment of the present invention.

FIG. 1 is a cross-sectional view of an ice maker for refrigeration equipment in accordance with an embodiment of the present invention.

With reference to FIG. 1, an ice maker of the present invention may include a cooling duct 102, a refrigerant pipe 104, a ventilator 106, an ice making refrigerant pipe 108, and an ice making unit 114. The ice making unit 114 may include an ice making tray 118 and an ice bucket 124. The ice making unit 114 may be a device (structure) installed in any one of a refrigerating compartment, a freezing compartment, and a door of the refrigeration equipment.

As an example, the cooling duct 102 forms a cold air channel which extends from a side of the cabinet of the refrigeration equipment, and discharges cold air chilled by a refrigerant to a targeted temperature (e.g., below the freezing point of water, e.g., below zero degrees Centigrade) to the inside of the ice making unit. 114 in which the ice bucket 124 is installed. To this end, the ventilator 106 (e.g., a fan) for ventilating the cold air is installed between an end of the cooling duct 102 and the inside of the ice making unit 114.

As shown by the direction of the arrows, in the embodiment of FIG. 1, the cooling duct 102 has a structure for collecting the cold air and discharging the cold air to the inside of the ice making unit 114 and the ice bucket 124. The cold air is returned to an inlet side of the cooling duct 102. In FIG. 1, reference numeral 116 represents a body frame of the ice making unit 114.

In an embodiment, the refrigerant pipe 104 is installed so that it encloses, or encloses at least a portion of, the cooling duct (or is in a shape entwining around the cooling duct) and functions as a refrigerant channel 105 that transfers the refrigerant flowing from the inflowing side of the refrigerant pipe. The ice making refrigerant pipe 108 for making water 120 into ice through heat-exchange is formed at end side of the refrigerant pipe 104 in the form of a branch off of the refrigerant pipe 104, and an end portion 110 of the pipe 108 is installed so that it is submerged in the water 120 contained in the ice making tray 118.

In an embodiment, the end portion 110 submerged in the water 120, for example, may be in the form of a number of pipe protrusions that protrude downwardly (in the downward direction) and have uniform lengths.

In other words, in accordance with an embodiment of the present invention, the ice maker has an ice making structure that uses a direct cooling system in which a refrigerant is transferred to (brought into thermal contact with) the water through the ice making refrigerant pipe 108 which branches off from the refrigerant pipe 104 and has an end portion 110 that is submerged in the water 120 contained in the ice making tray 118.

The heating member 112 for separating ice that forms on the end portion 110 is located on a surface of the end portion 110 that is formed on one side of the ice making refrigerant pipe 108 in the form of a number of pipe protrusions that are downwardly bent. As an example, the heating member 112 may include a heater and other related elements.

Accordingly, after an ice making mode is ended, a mode for separating ice is executed by heating the heater (heating member) using power supplied from a power source of the refrigeration equipment. Therefore, it is possible to separate (detach, or remove) the ice that is frozen on the end portion 110, and the separated ice is downwardly dropped and then is stored (kept) in the ice bucket 124.

In this embodiment, the ice making tray 118 has a predetermined amount of tilt (angle) to make the ice transparent, so that the water flows downward when it flows into the ice making tray 118. Therefore, the transparency of the ice is increased.

In addition, the vibrating member 122 may be installed at one side (for example, at the side or at the bottom face) of the ice making tray 118 containing the water 120 which is to be made into ice. The vibrating member 122 minutely vibrates the ice making tray 118 when the ice making unit 114 executes the ice making mode. Accordingly, transparency of the ice is further increased by making the water 120 vibrate (wave) as a result of the minute vibration of the vibrating member 122.

Figure 2:
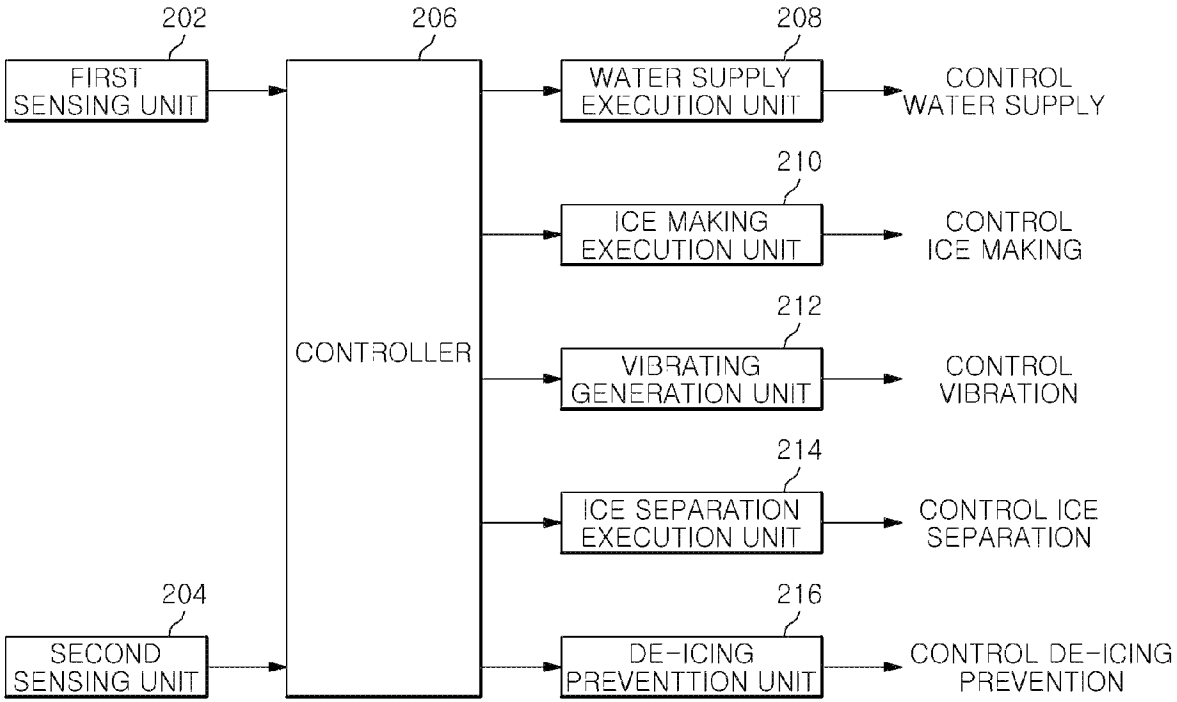
FIG. 2 is a block diagram of a circuit for operating an ice maker for refrigeration equipment in accordance with an embodiment of the present invention.

FIG. 2 is a block diagram of a circuit for operating an ice maker for refrigeration equipment in accordance with an embodiment of the present invention, in which the circuit may include a first sensing unit 202, a second sensing unit 204, a water supply execution unit 208, an ice making execution unit 210, a vibrating generation unit 212, an ice separation execution unit 214, and a de-icing prevention unit 216.

With reference to FIG. 2, the first sensing unit 202 may be a sensor for measuring a quantity of water (water used to make ice) supplied from a water storage tank (not shown) to the ice making tray 113, and may provide a function for detecting when the targeted quantity of water to be supplied is contained in the ice making tray 118 and then transferring that information to a controller 206.

The second sensing unit 204 may detect whether or not the water 120 contained in the ice making tray 113 is frozen. For example, the second sensing unit 204 may detect that ice making is completed (ended) by counting the amount of time during which the ice making mode is executed and then identifying when that amount of time reaches a predetermined reference time, or by correlating an ice making temperature with an ice making time. The detected ice making completion may then be signaled to the controller 206.

The controller 206, for example, may be a microprocessor performing overall operational control of the refrigeration equipment. The controller 206 may issue a valve shutoff command to shut off a water supply valve (not shown) of a water supply pipe supplying the water to the ice making tray 118 when completion of a water supply mode is detected by the first sensing unit 202 and may transfer the command to the water supply execution unit 208. The controller 206 may also issue a valve-opening command to open the water supply valve of the water supply pipe when the water supply mode is started for supplying the water and transfer the command to the water supply execution unit 208.

Further, the controller 206 may issue a vibration command to minutely vibrate the ice making tray 118 when the ice making mode is running according to the present invention, and may transfer the command to the vibrating generation unit 212.

In addition, the controller 206 may issue an ice making end command to end the ice making mode when ice making completion is detected by the second sensing unit. 204 and may transfer the ice making end command to the ice making execution unit 210. At the same time, the controller 206 may issue an ice separation command to separate the ice frozen on the end portion 110 of the ice making refrigerant pipe 108 and may provide the ice separation command to the ice separation execution unit 214. The controller 206 may also issue an ice making command to execute the direct cooling ice making mode using the refrigerant when the ice making mode is started and may transfer the ice making command to the ice making execution unit 210.

The water supply execution unit 208 may issue a water supply control signal (a valve-opening signal) to open a water supply valve of the water supply pipe when receiving the valve-opening signal, to start a water supply mode from the controller 206 and thus allow the water to be supplied to the ice making tray 118. Also, the water supply execution unit 208 may provide a control function to shut off the water supply valve of the water supply pipe when a valve shut off command is received from the controller 206.

The ice making execution unit 210 may provide a control function to bring the refrigerant into contact (thermal contact) with the water 120 in order to make ice by using the refrigerant channel 105 in the ice making area at which the ice making tray 118 is installed when the ice making command for executing the ice making mode is received. In addition, the ice making execution unit 210 may provide a control function to end an execution of the direct cooling ice making mode when the ice making end command is received from the controller 206.

The vibrating generation unit 212 may control vibration of the vibrating member 122 using a vibrating command transferred from the controller 206 when the ice making mode is executed.

Meanwhile, the ice separation execution unit 214 may provide a control function to separate ice frozen on the end portion 110 when the ice separation command is received from the controller 206 after the ice making mode is completed. As an example, the ice separation execution unit 214 may provide a control function to separate (detach, or remove) the ice by heating the heating member 112 formed on a surface of the end portion 110. The heating member 112 may be in the form of a tape.

In addition, the de-icing prevention unit 216 may provide a control function to provide cold air discharged from the cooling duct 102 to the ice bucket 124 using the ventilator 106 (e.g., a fan) and, therefore, it is possible to prevent the ice in the ice bucket 124 from being melted.

Hereinafter, a description will be made of a series of procedures for making water into ice through an ice making process using the refrigerant, and for preventing the ice from being melted when the ice is stored in the ice bucket by using an ice maker for the refrigeration equipment having the structure described above in accordance with the present invention.

Figure 3:
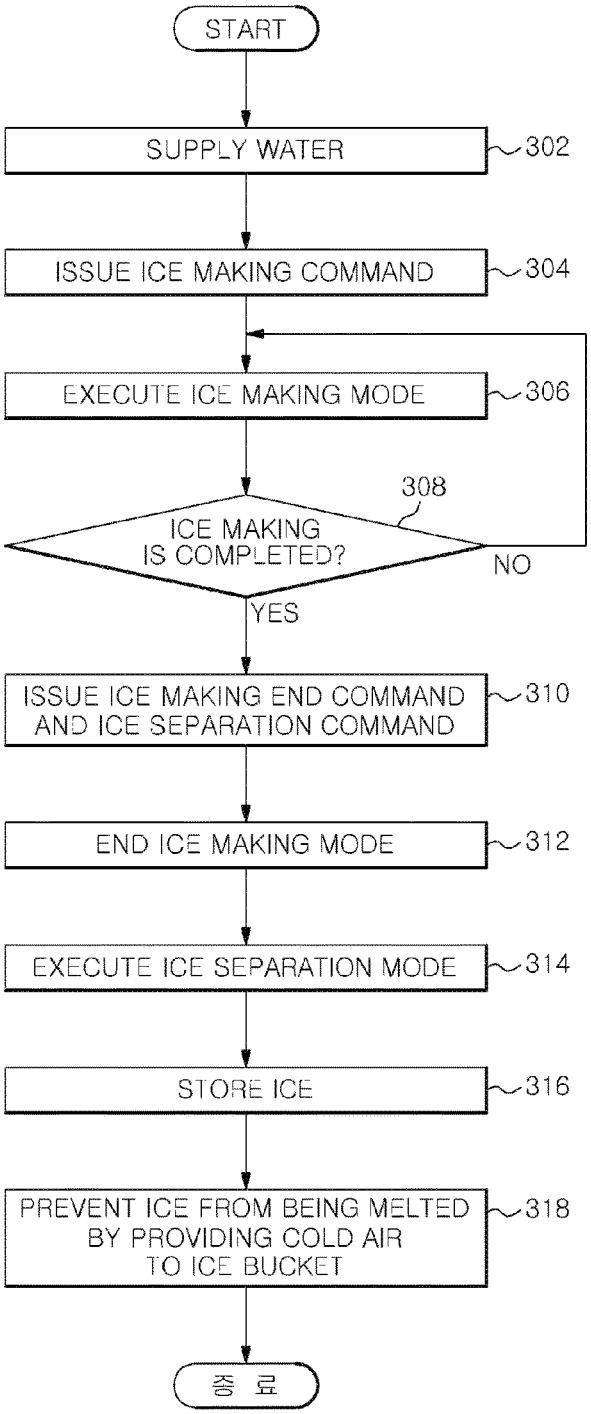
FIG. 3 is a flowchart showing example procedures for making ice, and for preventing the ice stored in the ice bucket from being melted in accordance with an embodiment of the present invention.

FIG. 3 is a flowchart showing example procedures for making ice, and for preventing the ice stored in the ice bucket from being melted in accordance with an embodiment of the present invention.

With reference to FIG. 3, at operation 302, the water supply executing unit 208 performs a water supply mode, and issues a water supply control signal to valve-opening signal) and allows the water to be supplied to the ice making tray 118 by opening a water supply valve of a water supply pipe if a water supply opening command is transferred from the controller 206, and shuts off the water supply valve of the water supply pipe if a valve shut off command is transferred from the controller 206.

Next, at operation 304, the controller 206 issues an ice making command to execute a direct cooling ice making mode using the refrigerant and then transfers the command to the ice making execution unit 210. In response, at operation 306, the ice making execution unit 210 carries out the ice making mode in which the refrigerant contacts (makes thermal contact with) the water 120 contained in the ice making tray 118 through the end portion 110 of the ice making refrigerant pipe 108 branched from the refrigerant pipe 104 that is submerged in the water.

While the ice making mode is running, the vibrating generation unit 212 operates the vibrating member 122 installed at one side of the ice making tray 118 according to a vibrating command transferred from the controller 206. Consequently, the ice making tray 118 may be minutely vibrated, which minutely vibrates the water to increase the transparency of the ice.

Next, when an ice making completion detection signal is inputted from the second sensing unit 204 at operation 308, the controller 206 issues an ice making end command in response to the ice making completion detection signal and transfers the command to the ice making execution unit 210. The controller 206 also issues an ice separation command and transfers that command to the separation execution unit 214, at operation 310. As a result, execution of the ice making mode is ended by the ice making execution unit 210, at operation 312.

Thereafter, in response to the ice separation command from the controller 206, the separation execution unit 214 executes a control function to separate the ice frozen on the end portion 110 of the ice making refrigerant pipe 108. That is, an ice separation mode is executed to separate (detach or remove) the ice, for example, by heating the heating member 112 formed on a surface of the end portion 110 in, for example, the form of a tape, at operation 314. By performing the ice separation mode, the ice separated (detached, removed) from the ice making tray 118 is dropped and is stored in the ice bucket 124, at operation 316. The ice stored in the ice bucket 124 may be discharged to the outside of the refrigeration equipment through an ice discharging port of a dispenser (not shown) in the door of refrigeration equipment.

Next, in response to a de-icing prevention command received from the controller 206, the de-icing prevention unit 216 controls the discharge of cold air to the ice bucket 124 through the cooling duct 102 forming a cold air channel, at operation 318. In this case, the de-icing prevention unit 216 may control operation of the ventilator 106 so that the cold air discharged through the cooling duct 102 can fully reach the ice bucket 124. As described above, the ice stored in the ice bucket 124 is not melted as a result of providing the cold air discharged through the cooling duct 102 to the ice bucket 124 using the ventilator 106 controlled by the de-icing prevention unit 216. Therefore, the problem in which melted ice in the ice bucket 124 is frozen together with nearby ice is solved.

The explanation set forth above merely describes a technical idea of the example embodiments of the present invention, and it will be understood by those skilled in the art to which this invention belongs that various changes and modifications may be made without departing from the scope of the essential characteristics of the embodiments of the present invention. Therefore, the example embodiments disclosed herein are not used to limit the technical idea of the present invent ion, but to explain the present invent ion, and the scope of the technical idea of the present invention is not limited to these embodiments.

Therefore, the scope of protection of the present invention should be construed as defined in the following claims and changes, modifications and equivalents that fall within the technical idea of the present invention are intended to be embraced by the scope of the claims of the present invention.

What is claimed is:

1. An ice maker for refrigeration equipment, comprising:

an ice making unit positioned in a refrigerating compartment of the refrigeration equipment and comprising an ice making tray;

an ice bucket disposed in the ice making unit and configured to store the ice made with the ice making tray;

a cooling duct configured to form a cold air channel through which cold air is provided to the ice making unit; and a refrigerant pipe entwined around a portion of the cooling duct to form a refrigerant channel, the refrigerant pipe extending away from the cooling duct and into the ice making unit, wherein a portion of the refrigerant pipe is configured to be submerged in water in the ice making tray, the refrigerant pipe extending through the ice making unit and back to the cooling duct; and wherein the cooling duct is further configured to collect the cold air discharged to the ice making unit and return the collected cold air to an inlet side of the cooling duct.

2. The ice maker for refrigeration equipment of claim 1, further comprising:

a ventilator configured to ventilate the cold air discharged from the cooling duct to the ice bucket.

3. The ice maker for refrigeration equipment of claim 1, wherein the portion of the refrigerant pipe has a number of pipe protrusions which are downwardly bent.

4. The ice maker for refrigeration equipment of claim 1, further comprising:

a heating member for separating ice that is frozen on the portion of the refrigerant pipe.

5. The ice maker for refrigeration equipment of claim 4, wherein the heating member comprises a heater powered by a power supply of the refrigeration equipment.

6. The ice maker for refrigeration equipment of claim 1, wherein refrigerant flows through the refrigerant pipe.

7. A method for making ice for use in refrigeration equipment, the method comprising:

containing water in an ice making tray of an ice making unit;

making ice by freezing the water in the ice making tray using a refrigerant flowing through a refrigerant pipe, wherein the refrigerant pipe is entwined around a portion of a cooling duct to form a refrigerant channel, wherein the cooling duct forms a cold air channel through which cold air is provided to the ice making unit, the refrigerant pipe extending away from the cooling duct and into the ice making unit, wherein a portion of the refrigerant pipe is submerged in water in the ice making tray, the refrigerant pipe extending through the ice making unit and back to the cooling duct;

executing an ice separation mode using a heating member installed on the portion of the refrigerant pipe and storing the ice separated from the ice making tray in an ice bucket; and discharging cold air to the ice bucket through the cooling duct, wherein said making ice comprises collecting the cold air discharged to the ice making unit and returning the collected cold air to an inlet side of the cooling duct.

8. The method of claim 7, wherein said discharging the cold air is executed using a ventilator which is installed on the cooling duct.

9. The method of claim 7, wherein the portion of the refrigerant pipe has a number of pipe protrusions which are downwardly bent.

10. An item of refrigeration equipment, comprising:

a body including a refrigerating compartment and a freezing compartment; and an ice maker coupled to the body, the ice maker comprising:

an ice making unit comprising an ice making tray;

an ice bucket disposed in the ice making unit and configured to store the ice made with the ice making tray;

a cooling duct configured to form a cold air channel through which cold air is provided to the ice making unit; and a refrigerant pipe entwined around a portion of the cooling duct to form a refrigerant channel, the refrigerant pipe extending away from the cooling duct and into the ice making unit, wherein a portion of the refrigerant pipe is configured to be submerged in water in the ice making tray, the refrigerant pipe extending through the ice making unit and back to the cooling duct; and wherein the cooling duct is further configured to collect the cold air provided to the ice making unit and return the collected cold air to an inlet side of the cooling duct.

11. The refrigeration equipment of claim 10, further comprising:

a ventilator configured to ventilate the cold air discharged from the cooling duct to the ice bucket.

12. The refrigeration equipment of claim 10, wherein the portion of the refrigerant pipe has a number of pipe protrusions which are downwardly bent.

13. The refrigeration equipment of claim 10, further comprising:

a heating member for separating ice that is frozen on the portion of the refrigerant pipe.

14. The refrigeration equipment of claim 13, wherein the heating member comprises a heater powered by a power supply of the refrigeration equipment.

15. The refrigeration equipment of claim 10, wherein refrigerant flows through the refrigerant pipe.

* * * * *